US008322290B1

(12) United States Patent
Mignano

(10) Patent No.: US 8,322,290 B1
(45) Date of Patent: Dec. 4, 2012

(54) MULTI-USE TABLE

(76) Inventor: Giancarlo Mignano, Miami, FL (US)

( * ) Notice: Subject to any disclaimer, the term of this patent is extended or adjusted under 35 U.S.C. 154(b) by 495 days.

(21) Appl. No.: 12/572,557

(22) Filed: Oct. 2, 2009

Related U.S. Application Data

(63) Continuation-in-part of application No. 11/603,438, filed on Nov. 22, 2006, now abandoned.

(51) Int. Cl.
*A47F 5/12* (2006.01)

(52) U.S. Cl. ..... 108/9; 108/27; 108/157.1; 108/25; 108/43; 248/456

(58) Field of Classification Search ..... 108/6, 9, 108/25, 27, 117, 43, 157.1; 248/444, 447, 248/454–457
See application file for complete search history.

(56) References Cited

U.S. PATENT DOCUMENTS

| | | | | |
|---|---|---|---|---|
| 3,475,052 | A * | 10/1969 | Kaposi | 248/456 |
| 4,467,727 | A * | 8/1984 | Strommer | 108/23 |
| 4,848,243 | A * | 7/1989 | Giordano | 108/9 |
| 5,265,541 | A * | 11/1993 | Gordon | 108/34 |
| 5,568,773 | A | 10/1996 | Hung | |
| 5,593,128 | A | 1/1997 | Odom et al. | |
| 5,992,331 | A | 11/1999 | Inoue et al. | |
| 6,113,050 | A | 9/2000 | Rush | |
| 6,152,417 | A * | 11/2000 | Randall | 248/460 |
| 6,311,944 | B1 | 11/2001 | McKsymick et al. | |
| 6,439,133 | B1 | 8/2002 | Jaramillo | |
| 6,445,378 | B1 | 9/2002 | Flagg | |
| 6,526,895 | B1 | 3/2003 | Kochanski et al. | |
| 7,073,449 | B2 * | 7/2006 | Pipkin | 108/44 |
| 7,121,214 | B1 | 10/2006 | Toltzman et al. | |
| 7,172,167 | B2 * | 2/2007 | Phifer et al. | 248/460 |
| 7,293,751 | B2 * | 11/2007 | Eriksson | 108/43 |
| 2005/0150433 | A1 | 7/2005 | Lo | |
| 2006/0032417 | A1 | 2/2006 | Goschy et al. | |
| 2007/0151487 | A1 * | 7/2007 | Villapanda et al. | 108/43 |
| 2007/0175367 | A1 | 8/2007 | Layh | |
| 2008/0041282 | A1 | 2/2008 | Goschy et al. | |

FOREIGN PATENT DOCUMENTS

| | | |
|---|---|---|
| DE | 3939216 | 9/2003 |

* cited by examiner

*Primary Examiner* — Hanh V Tran
(74) *Attorney, Agent, or Firm* — Ariel S. Bentolila; Bay Area IP Group, LLC

(57) ABSTRACT

A multi-use table includes a tabletop; a pair of legs carried by the tabletop; and a mouse pad having a mouse pad body carried by the tabletop, a track ball mouse carried by the mouse pad body and an interface cable connected to the track ball mouse. The multi-use table can include a tilting tabletop having a tab, which is removably inserted into a slot within a table base. An angle support assembly is hingeably coupled to a center lower surface of the tilting tabletop. The angle support engages with a feature within the table base such that the tilting tabletop remains at an angle. An anti-slip material can be disposed upon the top surface of the tabletop for securing a laptop.

20 Claims, 10 Drawing Sheets

MULTI-USE TABLE

CROSS-REFERENCE TO RELATED APPLICATIONS

This application is a Continuation-In-Part which claims the benefit of co-pending U.S. Non-Provisional patent application Ser. No. 11/603,438, filed on Nov. 22, 2006, which is incorporated herein in its entirety.

FIELD OF THE INVENTION

The present invention relates to tables. More particularly, the present invention relates to a multi-use table that is lightweight, portable and versatile and is particularly suitable for supporting a laptop computer.

BACKGROUND OF THE INVENTION

In recent years, the size of personal computers has been progressively reduced to enhance portability while maintaining or increasing computational power and speed of the computers. Advances in the speed of integrated circuits, battery technology and memory storage capacity have resulted in computers that are small and lightweight and can be operated for hours without connection to an external energy supply. Due to their portability, laptop computers (also known as notebook computers) are extensively used outside the home and office.

Laptop computers are typically carried in a carrying case for use on airplanes, at seminars and in classrooms, bookstores, restaurants, coffee shops and the like. In many locations, a user places the laptop computer in his or her lap during use. This requires the user to stabilize the laptop in his or her lap while simultaneously typing or entering commands into the laptop using a keyboard and/or mouse. This method, however, can be awkward and uncomfortable and places excessive strain on the user's hands and arm muscles. This instability is further compounded when a user attempts to use the laptop while reclining in bed. Again, this instability is even further compounded when the user is pregnant or overweight.

Another drawback, which is associated with placing a laptop computer directly on the legs or lap of a user, is that a substantial quantity of heat is dissipated from the laptop during operation, frequently resulting in discomfort to the user. Therefore, a multi-use table is needed which is versatile, lightweight and portable and is suitable for comfortably supporting a laptop computer in a functional position during use. It would be further desirable to provide such a table having a configuration providing maximum flexibility vis-à-vis positioning and orienting the computer when the user is in a reclined position.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the Figures, the present invention is generally directed to a multi-use table is needed which is versatile, lightweight and portable and is suitable for comfortably supporting a laptop computer in a functional position during use. The multi-use table is capable of being folded into a storage configuration when not in use.

Figure 1:
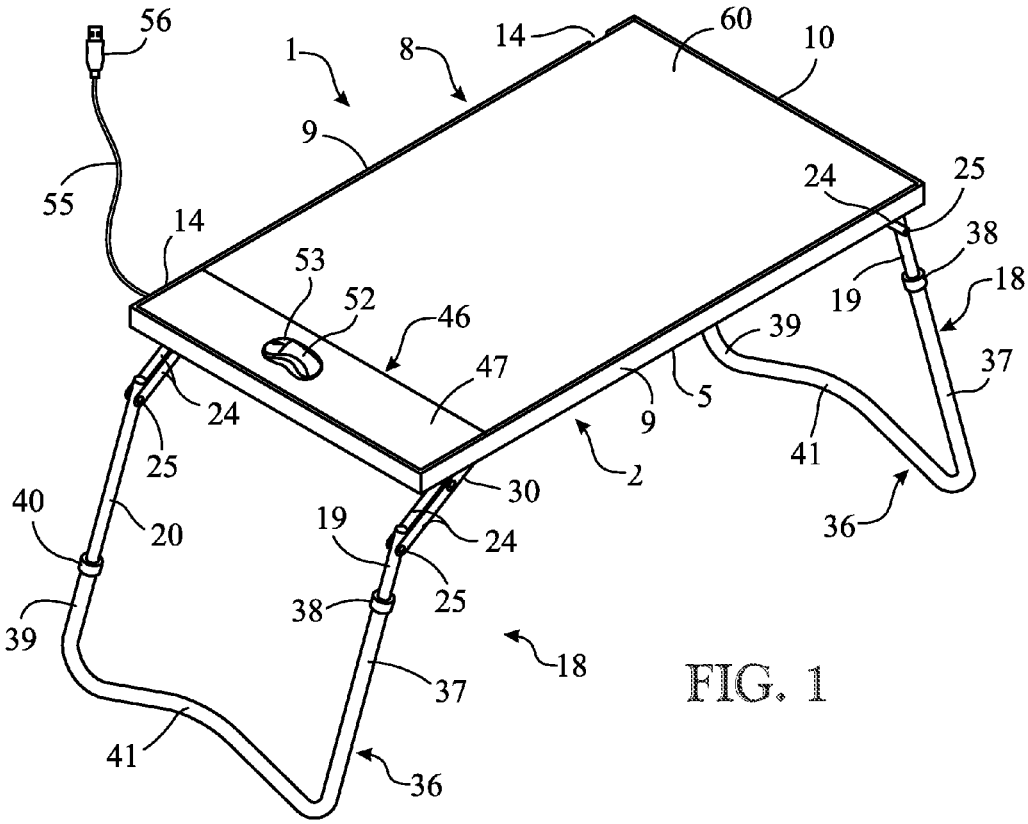
FIG. 1 is a front perspective view of an illustrative embodiment of the multi-use table, deployed in a functional position.
Figure 5:
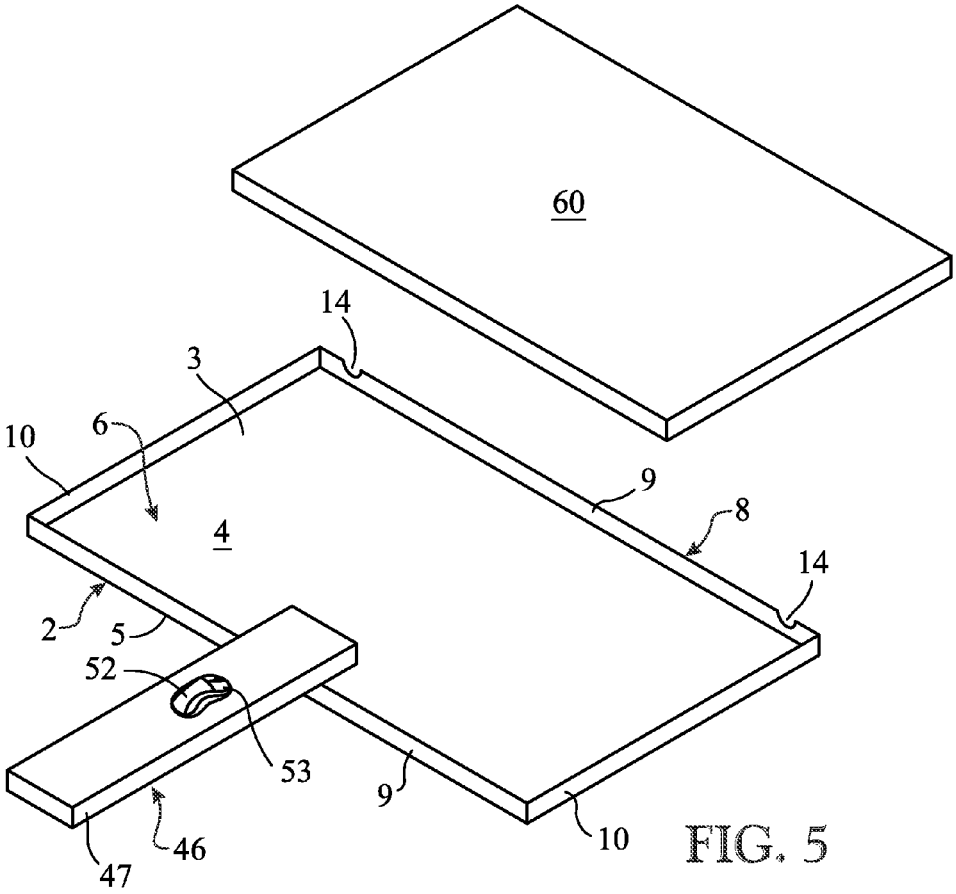
FIG. 5 is an exploded, perspective view illustrating removable placement of a mouse pad and a table board pad in a tabletop element of an illustrative embodiment of the multi-use table.
Figure 6:
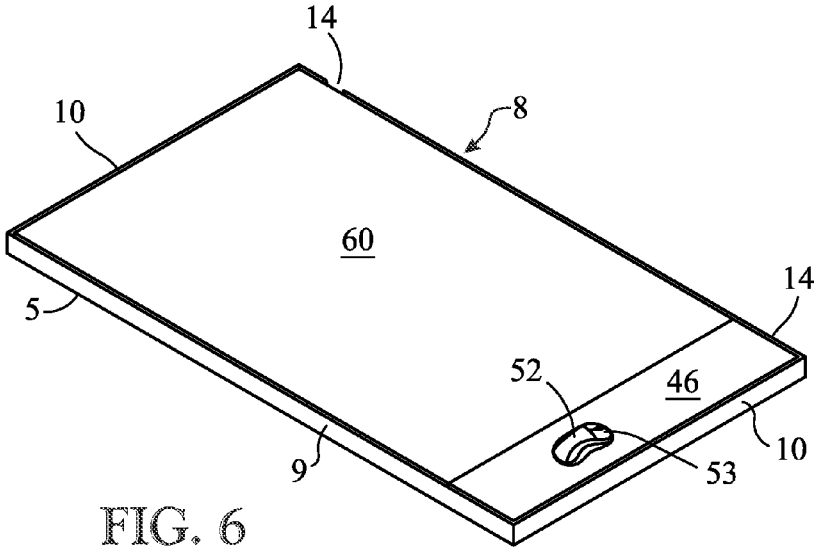
FIG. 6 is a perspective view of a tabletop element of an illustrative embodiment of the multi-use table, with a mouse pad and a table board pad placed in the tabletop.

Referring to the drawings, an illustrative embodiment of the multi-use table is generally indicated by reference numeral 1. The multi-use table 1 includes a tabletop 2 which may be plastic, for example. In some embodiments of the multi-use table 1, the tabletop 2 has a generally elongated, rectangular shape, as shown, although the tabletop 2 may have alternative shapes. As illustrated in FIG. 5, the tabletop 2 includes a tabletop panel 3 having a support surface 4 and a leg attachment surface 5. A tabletop lip 8 extends from the perimeter of the tabletop panel 3, beyond the plane of the support surface 4. In embodiments in which the tabletop 2 has a generally elongated, rectangular shape, the tabletop lip 8 typically includes a pair of generally elongated, parallel longitudinal lip segments 9 and a pair of generally elongated parallel transverse lip segments 10. As illustrated in FIGS. 1, 5 and 6, in some embodiments of the multi-use table 1, a pair of notches 14, the purpose of which will be hereinafter described, is provided in one of the longitudinal lip segments 9 of the tabletop lip 8 for purposes that will be hereinafter described. As illustrated in FIG. 5, the tabletop panel 3 and the tabletop lip 8 define a tabletop interior 6.

Figure 7:
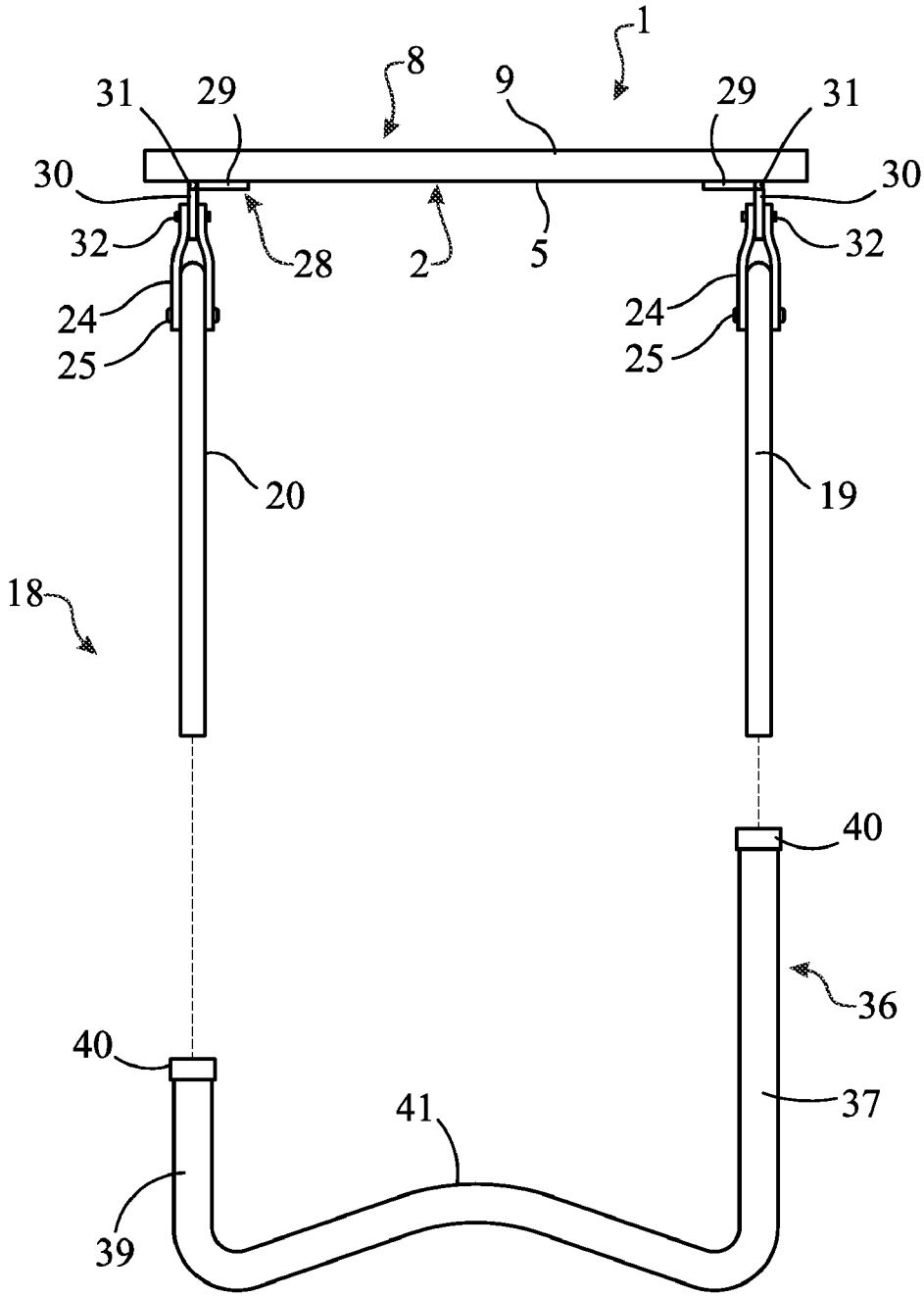
FIG. 7 is an exploded end view illustrating detachment of a leg connector element from front and rear connector attachment segments in partial disassembly of an illustrative embodiment of the multi-use table.
Figure 8:
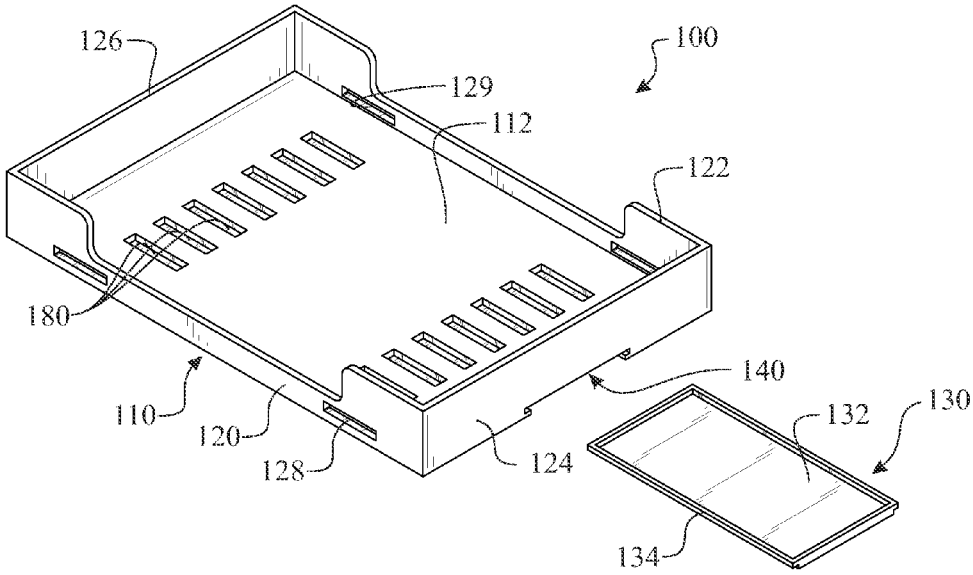
FIG. 8 is a general exploded perspective view of an alternate tabletop base for integration with the multi-use table of the present invention, showing a mouse tray removed from the right side of said table.
Figure 9:
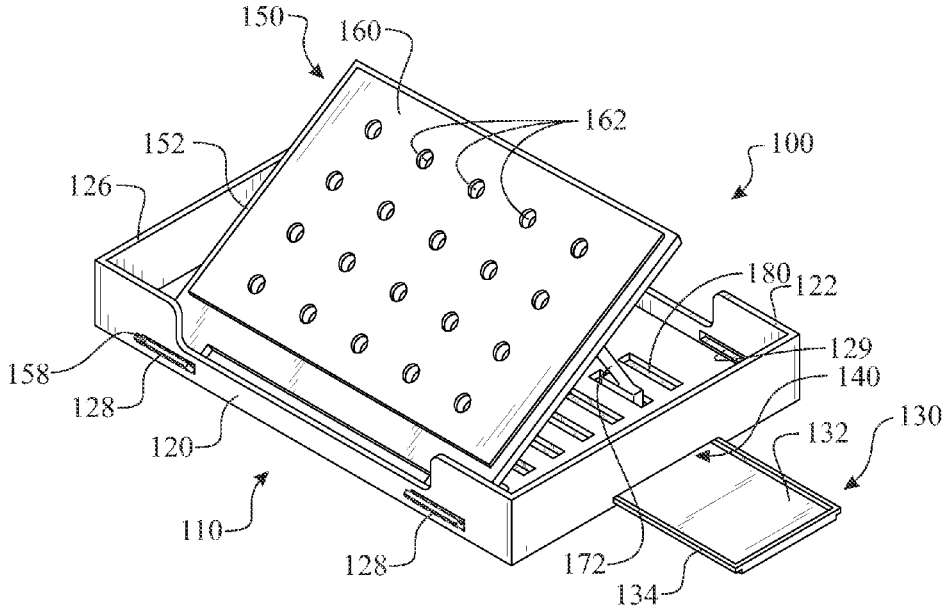
FIG. 9 is another general perspective view illustrating a tilting tabletop installed in the alternate tabletop base of FIG. 8, presented in an assembled, configured for use configuration.
Figure 10:
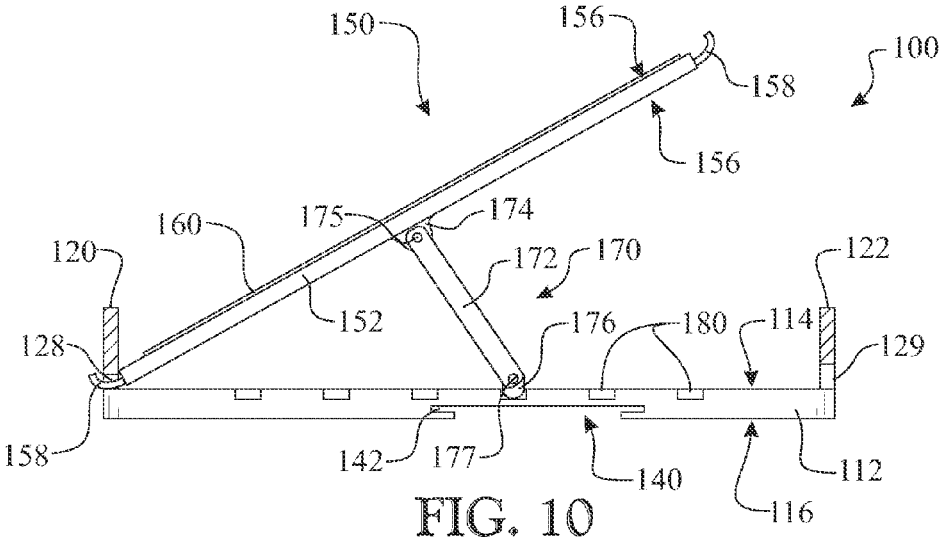
FIG. 10 is a partially sectioned, elevation side view of the tilting tabletop assembly.

A pair of spaced-apart legs 18 is provided on the tabletop 2. Each leg 18 is attached to the leg attachment surface 5 of the tabletop panel 3 typically in a manner that will be hereinafter described. Each leg 18 typically includes a front leg segment 19 and a rear leg segment 20, each of which is pivotally attached to the leg attachment surface 5. In some embodiments, at least one of the front leg segment 19 and the rear leg segment 20 is pivotally attached to the leg attachment surface 5 of the tabletop 2. In some embodiments, both the front leg segment 19 and the rear leg segment 20 are pivotally attached to the leg attachment surface 5 of the tabletop 2. For example, as illustrated in FIG. 7, in some embodiments of the multi-use table 1, a pair of leg segment hinges 28 is provided on the leg attachment surface 5. Each leg segment hinge 28 includes an attachment leaf 29, which is attached to the leg attachment surface 5. A bracket leaf 30 is pivotally attached to the attachment leaf 29 along a pivot point 31. A bracket hinge 24 is pivotally attached to the bracket leaf 30 of each attachment segment hinge 28 at a pivot pin 32. The front leg segment 19 and the rear leg segment 20 are pivotally attached to the corresponding bracket hinge 24 at a pivot pin 25.

A leg connector 36 connects the front leg segment 19 to the rear leg segment 20 of each leg 18. The leg connector 36 may be any suitable shape and configuration. In some embodiments of the multi-use table 1, the leg connector 36 includes a generally elongated, tubular front connector segment 37 having an attachment collar 38; a generally elongated, tubular rear connector segment 39 which is typically shorter than the front connector segment 37 and has an attachment collar 40; and a generally elongated, tubular, curved connecting segment 41 which connects the front connector segment 37 to the rear connector segment 39. Accordingly, the legs 18 can be selectively deployed in the extended, functional, tabletop-supporting configuration illustrated in FIGS. 1, 3 and 4 by extending the front leg segment 19 and the rear leg segment 20 from the leg attachment surface 5 of the tabletop 2 and extending the front leg segment 19 and the rear leg segment 20 outwardly and downwardly with respect to each bracket hinge 24. The front connector segment 37 and the rear connector segment 39 of the leg connector 36 receive the front leg segment 19 and the rear leg segment 20, respectively. The attachment collar 38 facilitates attachment of the front connector segment 37 to the front leg segment 19, whereas the attachment collar 40 facilitates attachment of the rear connector segment 39 to the rear leg segment 20. As illustrated in FIG. 7, the legs 18 can be selectively disassembled and folded for storage by detaching the leg connector 36 from the front leg segment 19 and the rear leg segment 20; pivoting the front leg segment 19 and rear leg segment 20 with respect to the corresponding bracket hinge 24 along the pivot pin 25; pivoting the bracket hinge 24 with respect to the bracket leaf 30 of the corresponding leg segment hinge 28 along the pivot pin 32; and pivoting the bracket leaf 30 with respect to the attachment leaf 29 of the corresponding leg attachment hinge 28 along the pivot point 31.

Figure 2:
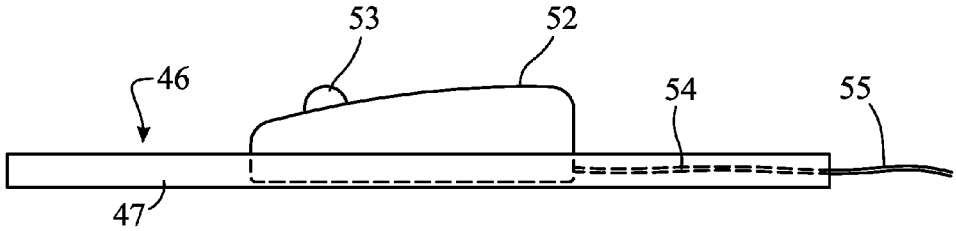
FIG. 2 is a side view of a mouse pad element of an illustrative embodiment of the multi-use table.

As illustrated in FIGS. 1, 2, 5 and 6, a mouse pad 46 can be removably inserted in the tabletop interior 6 of the tabletop 2. The mouse pad 46 includes a generally elongated, rectangular mouse pad body 47. The length of the mouse pad body 47 generally corresponds to the distance between the spaced-apart longitudinal segments 9 of the tabletop lip 8. A track ball mouse 52, which may be conventional, is provided on the mouse pad 46. The track ball mouse 52 has a track ball 53. As illustrated in FIG. 2, in some embodiments of the multi-use table 1, the track ball mouse 52 is embedded in the mouse pad body 47. In other embodiments of the multi-use table 1, the track ball mouse 52 is attached to the surface of the mouse pad body 47. Mouse wiring 54 extends from the track ball mouse 52, typically through a wiring opening (not illustrated), which is provided in the mouse pad body 47. An interface cable 55, such as a standard USB cable, for example, is connected to the mouse wiring 54 and extends from the mouse pad body 47. As illustrated in FIG. 1, the interface cable 55 terminates in an interface plug 56. When the mouse pad 46 is seated in the tabletop interior 6, the interface cable 55 extends through one of the cable notches 14 provided in the longitudinal segment 9 of the tabletop lip 8. It will be appreciated by those skilled in the art that the mouse pad 46 can be selectively seated in the far left-handed area or the far right-handed area of the tabletop interior 6 depending on whether the multi-use table 1 is to be used by a left-handed user or a right-handed user, as will be hereinafter described. As further illustrated in FIGS. 5 and 6, a table board pad 60 can be seated in the tabletop interior 6, adjacent to the mouse pad 46 to fill the remaining portion of the tabletop interior 6 and provide a support surface for a laptop computer (not illustrated) on the tabletop 2, as will be hereinafter described.

Figure 3:
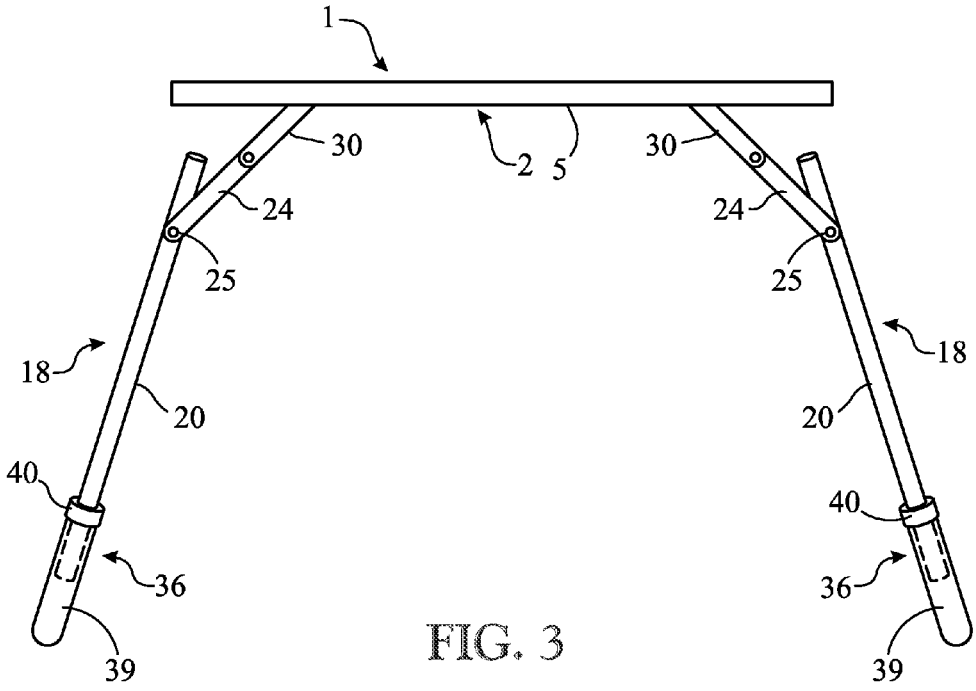
FIG. 3 is a front view of an illustrative embodiment of the multi-use table, deployed in a functional position.
Figure 4:
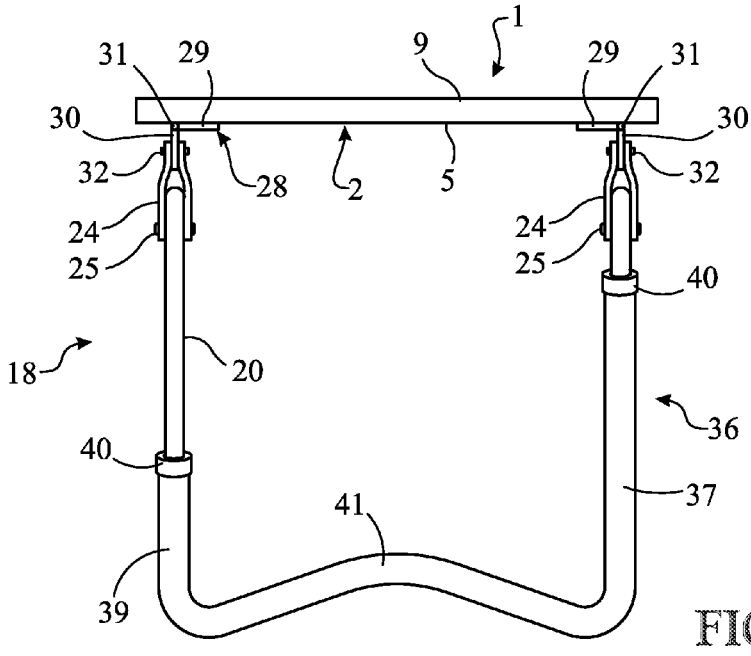
FIG. 4 is an end view of an illustrative embodiment of the multi-use table, deployed in a functional position.

In typical use of the multi-use table 1, the legs 18 are deployed in the extended, functional position with respect to the tabletop 2, as illustrated in FIGS. 1, 3 and 4. The tabletop 2 can be positioned over the lap of a user (not illustrated) by supporting the legs 18 on the seat of a chair (not illustrated) on respective sides of the user's legs, for example. The mouse pad 46 is seated in the tabletop interior 6 of the tabletop 2. The table board pad 60 is also seated in the tabletop interior 6, adjacent to the mouse pad 46. A laptop computer (not illustrated) is placed on the table board pad 60. The interface plug 56 on the end of the interface cable 55, which extends from the mouse pad body 47 of the mouse pad 46, is plugged into an interface port (not illustrated) such as a USB port, for example, provided on the laptop computer. Accordingly, the track ball mouse 52 can be operated to scroll through items presented on the screen (not illustrated) of the laptop computer by rotation of the track ball 53, typically in the conventional manner. Depending on whether the user of the laptop computer is left-handed or right-handed, the mouse pad 46 can be placed on either the far left-handed area or the far right-handed area, respectively, of the tabletop 2. It will be appreciated by those skilled in the art that the multi-use table 1 supports the laptop computer in a comfortable position over the user's lap, thereby minimizing fatigue and strain of the user's arms and hands. Furthermore, heat generated by the laptop computer is dissipated through the tabletop 2, and therefore, contact of the user's lap by excessive heat is prevented or minimized. The multi-use table 1 is amenable to alternative uses such as in the support of a book (not illustrated) while the user reads or in the support of food (not illustrated) as the user eats, for example. When not in use, the legs 18 of the multi-use table 1 can be partially disassembled and folded against the tabletop 2, typically in the manner that was heretofore described with respect to FIG. 7, to facilitate easy carrying and space-efficient storage of the multi-use table 1.

An enhanced table top, referred to as a tilting laptop table assembly 100, is presented in FIGS. 8 through 12. The tilting laptop table assembly 100 integrates a tilting tabletop assembly 150 within a table base assembly 110, providing a tabletop capable of being positioned at any of a variety of angles. The tilting tabletop assembly 150 can tilt, angling towards the front of the table base assembly 110 or the rear of the table base assembly 110, allowing the user to rotate the tilting laptop table assembly 100 180 degrees. This ability positions a mouse tray 130 for a right-handed user (positioned to the right) and a left-handed user (positioned to the left).

The table base assembly 110 is fabricated having a horizontally oriented base bottom 112 and a plurality of vertical walls being contiguous about a perimeter of the base bottom 112. The peripheral walls include a front wall 120, a rear wall 122, a first sidewall 124, and a second sidewall 126. At least one front pivot tab receiving slot 128 is provided in the front wall 120. The base bottom 112 includes a pair of longitudinal edges, being respective to the front wall 120 and rear wall 122 and a pair of lateral edges, being respective to the sidewalls 124, 126. At least one rear pivot tab receiving slot 129 is provided in the rear wall 122. A series of support brace receiving recess 180 are provided in a base top surface 114 of the base bottom 112. A mouse tray receiving cavity 140 is formed along a lower edge of the first sidewall 124 and into the base bottom surface 116 for receiving a mouse tray 130. A pair of spaced-apart legs 18 (FIG. 1) can be attached to a base bottom surface 116 of the base bottom 112. The legs 18 are not shown, providing clarity for describing the tilting laptop table assembly 100. The legs are preferred to be angled outward (left and right) allowing for placement over one's hips or waist when lying in a bed.

The tilting tabletop assembly 150 includes a tilting tabletop 152 being a rigid structure having a size and shape that fits within the confines defined by the plurality of vertical walls 120, 122, 124, 126. The tilting tabletop 152 preferably has a flat tabletop lower surface 156. The tilting tabletop 152 can be of wood, plastic, metal, any type of composite materials, and the like, as well as any combination thereof. The tilting tabletop 152 can include a planar upper surface having a lattice or other framework substructure for supporting weight across the tabletop upper surface 154. An anti-slip surface 160 can be applied into the tabletop lower surface 156, providing a surface capable of holding an object such as a laptop computer, while the tilting tabletop 152 is tilted. A series of cooling apertures 162 can be provided through the anti-slip surface 160 and the tilting tabletop 152 providing airflow for cooling the laptop or any other like device.

At least one tabletop pivot tab 158 is provided along at least one of a front and a rear edge of the tilting tabletop 152. The tabletop pivot tab 158 are formed to engage with the pivot tab receiving slots 128, 129, allowing the tilting tabletop 152 to pivot about the tab-slot interface. In one exemplary illustration (FIG. 8), a pair of tabletop pivot tab 158 is provided along the front edge of the tilting tabletop 152. In a second exemplary illustration (FIG. 10), two pair of tabletop pivot tab 158 are provided, a first pair being incorporated along the front edge of the tilting tabletop 152 and a second pair being incorporated along the rear edge of the tilting tabletop 152. In the first embodiment, the user would disengage the tabletop pivot tab 158 from the front pivot tab receiving slot 128 in the front wall 120 and rotate the tilting tabletop assembly 150 and insert the tabletop pivot tab 158 into the rear pivot tab receiving slot 129 in the rear wall 122. In the second embodiment, the user would disengage the front tabletop pivot tab 158 from the front pivot tab receiving slot 128 in the front wall 120 and insert the rear tabletop pivot tab 158 into the rear pivot tab receiving slot 129 in the rear wall 122. The tabletop pivot tab 158 can be either flat or curved (as shown) and the front pivot tab receiving slot 128, 129 being sized allowing the tilting tabletop 152 to use the interface as a hinge.

The tilting tabletop 152 is supported at an angle via an angle support assembly 170. The angle support assembly 170 includes an angle support brace 172, which is hingeably coupled to a tabletop lower surface 156 of the tilting tabletop 152 via a support brace bracket 174. A bracket hinge member 175 is inserted rotatably coupling the angle support brace 172 and the support brace bracket 174. A distal end of the angle support brace 172 can include a foot 176 rotatably coupled to the angle support brace 172 via a foot hinge member 177. The foot 176 is designed such, allowing it to be inserted into any of the series of support brace receiving recesses 180, thus positioning the angle support brace 172 to maintain the tilting tabletop 152 at a desired angle. It is understood the tilting tabletop assembly 150 can include a single angle support assembly 170, a pair of angle support assembly 170 or utilize an angle support brace 172 in any of a variety of form factors. The foot 176 can be of any suitable size and shape and can be integrated thereon or coupled to the distal end of the angle support brace 172.

Figure 11:
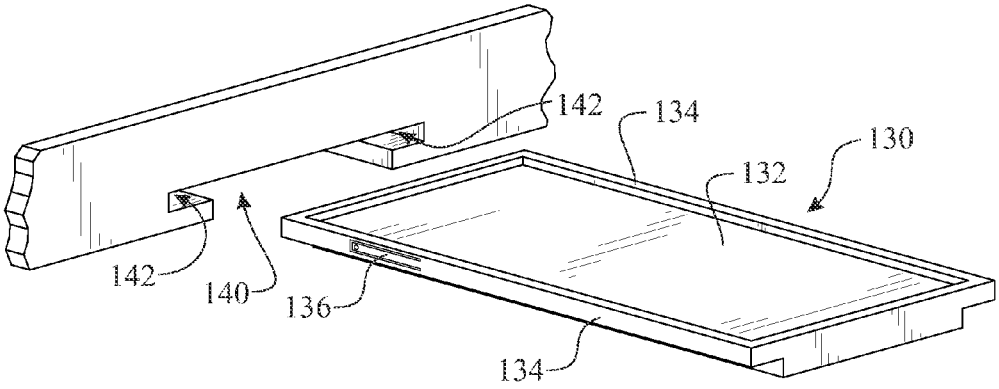
FIG. 11 is another perspective detailing the mouse tray and the mouse tray receiving slot.
Figure 12:
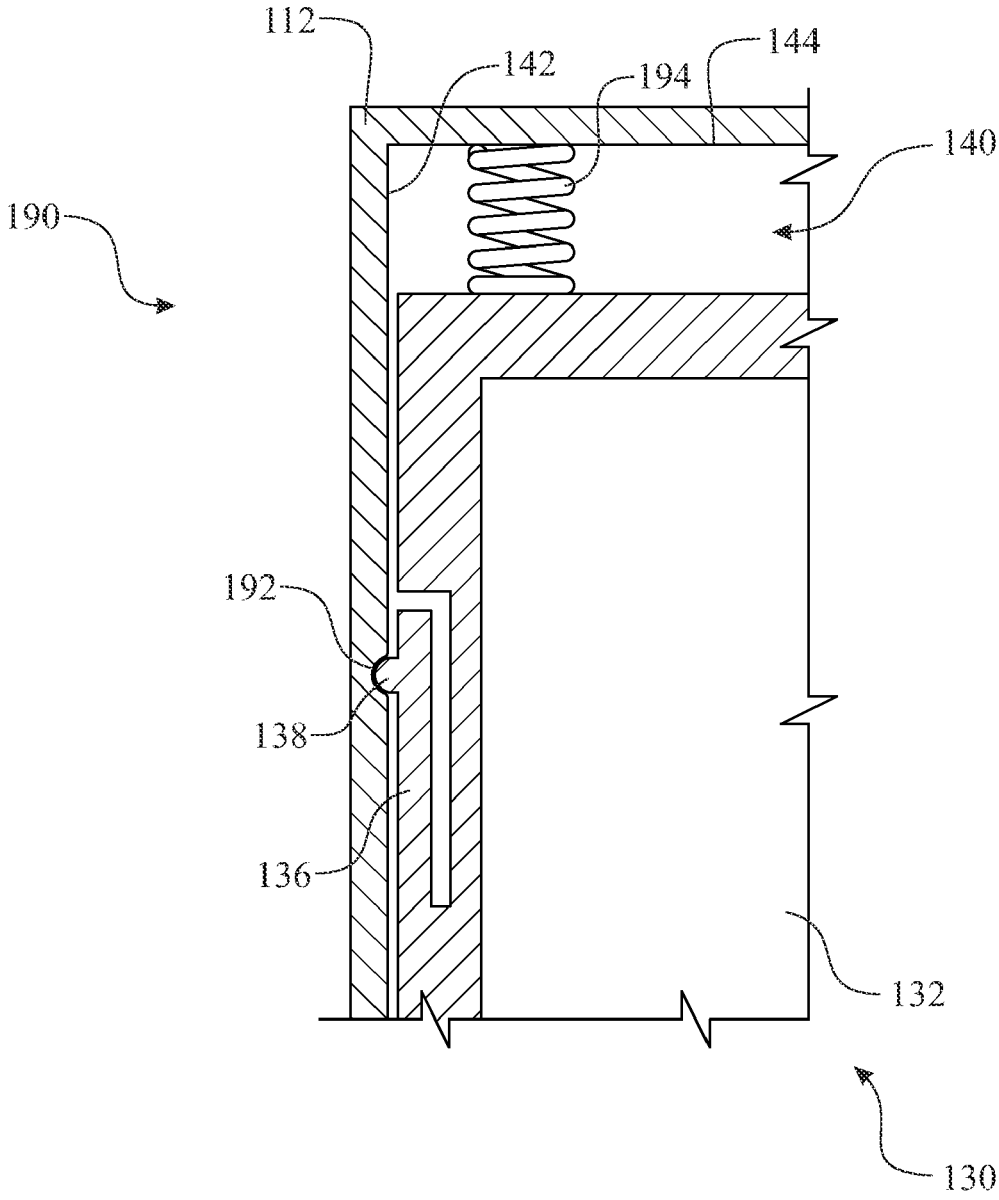
FIG. 12 is a sectional view of the mouse tray and slot showing a storage latching and releasing system.

The mouse tray 130 is detailed in FIGS. 11 and 12 and can include an optional tray latch and ejection system 190. The mouse tray includes a mouse placement surface 132 for holding a mouse, a trackball, a small tablet, a numeric keyboard, and the like. The mouse tray 130 is inserted into the mouse tray receiving cavity 140 via slideably engaging the engaging flange 134 with the flange receiving slot 142. The illustrated configuration utilizes a "T" shaped interface. It is understood other slideably interfaces, such as a dovetail, and the like, can be used. The tray latch and ejection system 190 utilizes a latch nib 138 disposed upon a latch cantilever 136. The latch cantilever 136 is preferably formed within the sidewall of the mouse tray 130 in a cantilevered arrangement. A nib engaging indentation 192 is provided within the edge wall of the flange receiving slot 142. A release spring 194 is assembled between a tray cavity end wall 144 and a rear wall of the mouse tray 130. The user inserts the mouse tray 130 into the mouse tray receiving cavity 140 until the latch nib 138 engages with the nib engaging indentation 192, securing the mouse tray 130 in a stored configuration. The user would then apply a force to the mouse tray 130 compressing the release spring 194 and disengaging the latch nib 138 from the nib engaging indentation 192. The user releases the force and the release spring 194 ejects the mouse tray 130 from the mouse tray receiving cavity 140. The motion generated by the release spring 194 causes the latch nib 138 to pass across the nib engaging indentation 192, avoiding engagement during the ejection process. A second nib engaging indentation 192 can be provided closer to an opening of the mouse tray receiving cavity 140 for temporarily securing the mouse tray 130 in an in-use configuration. It is understood there are many different configurations, which secure the mouse tray 130 in a stored configuration within the base bottom 112, while incorporating an ejection system.

Figure 13:
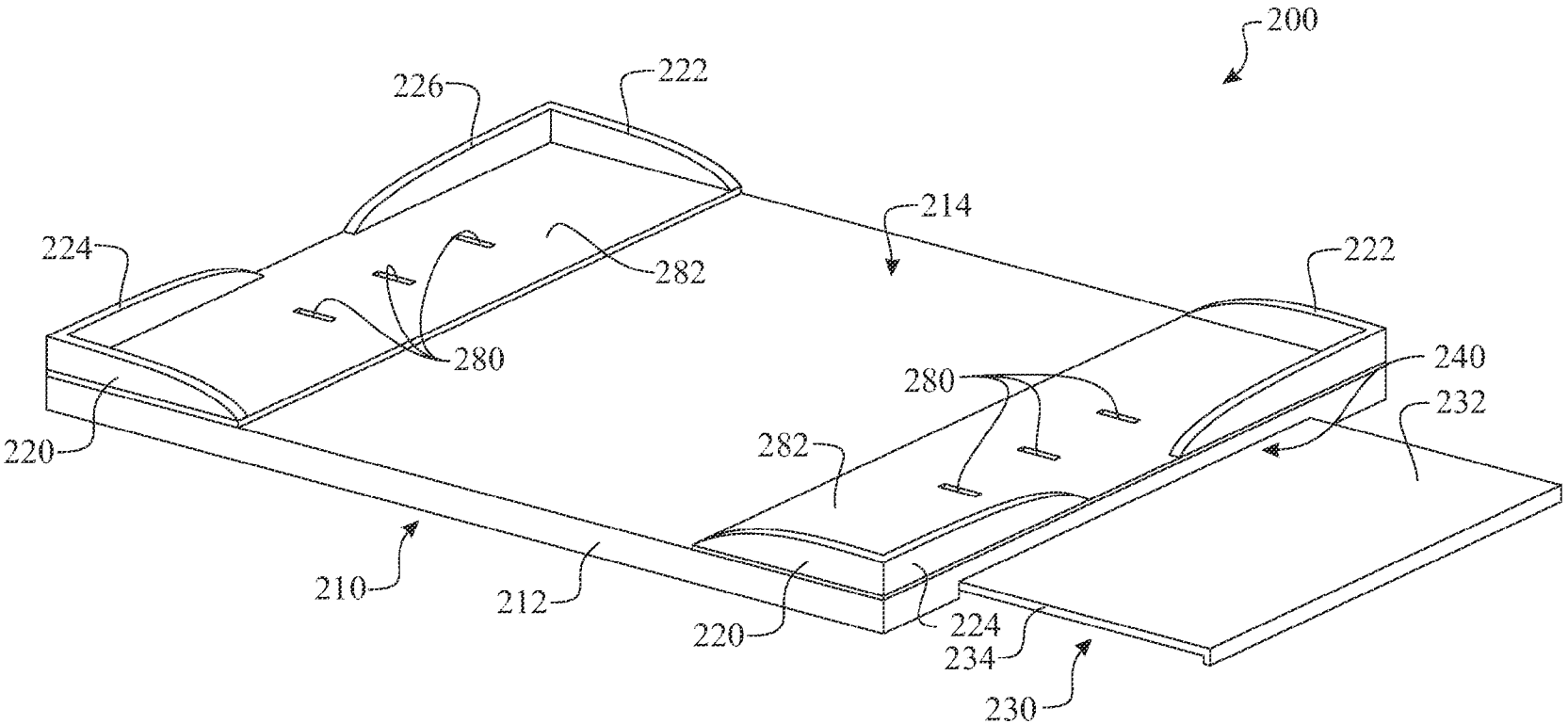
FIG. 13 is a perspective view of another exemplary alternate embodiment of a tilting tabletop, illustrating the base portion of the assembly.
Figure 14:
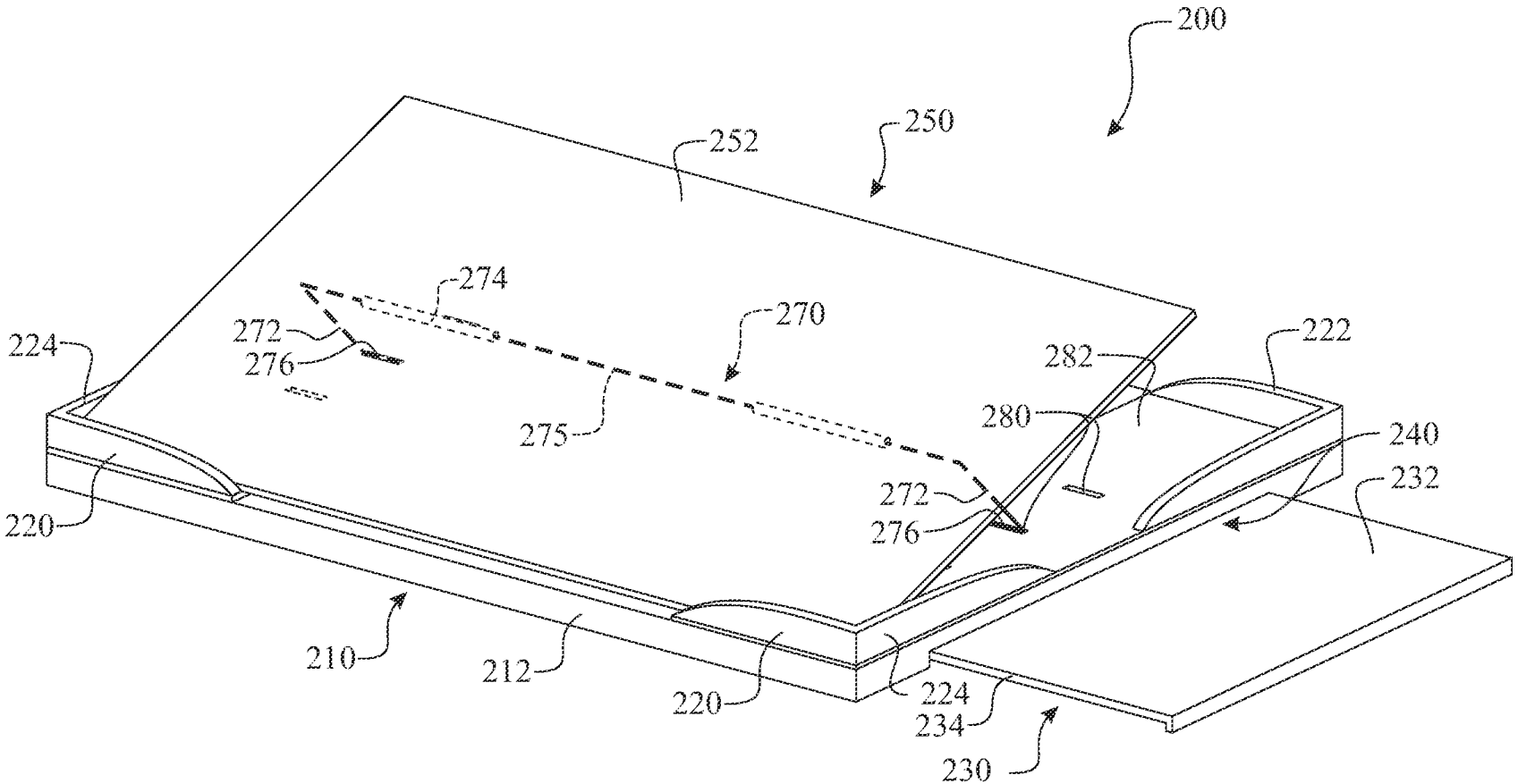
FIG. 14 is a perspective view of the tilting tabletop of FIG. 13, introducing the tilting tabletop portion assembled to the base.
Figure 15:
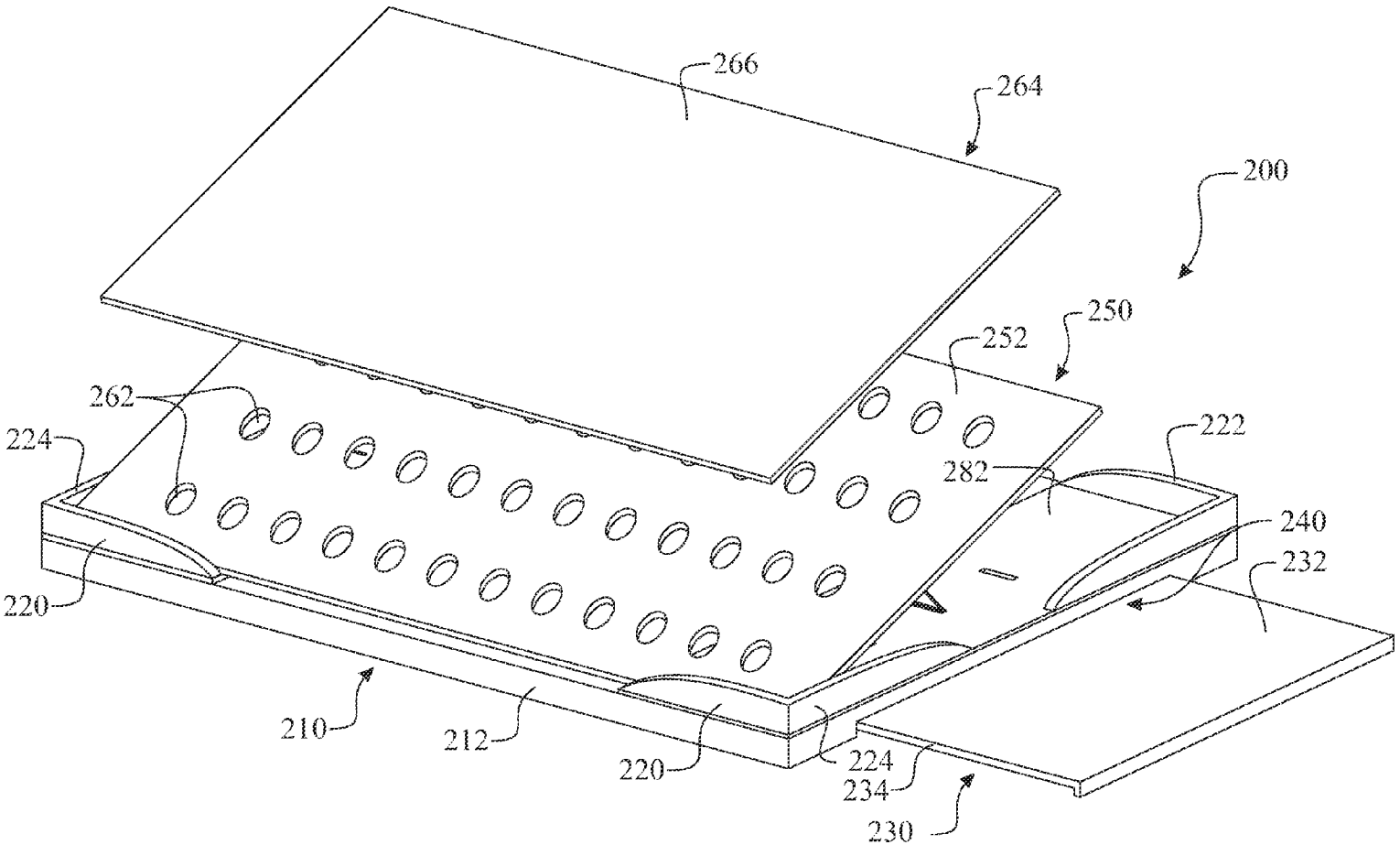
FIG. 15 is a perspective view of the tilting tabletop of FIG. 14, the tabletop further incorporating cooling apertures.

An alternate exemplary tilting tabletop, referred to as a tilting laptop table assembly 200, is presented in FIGS. 13 through 15. The tilting laptop table assembly 200 comprises several subassemblies, including a table base subassembly 210, a mouse tray 230, and a tilting tabletop assembly 250. The table base subassembly 210 is detailed in FIG. 13. The tilting tabletop assembly 250 is introduced in FIG. 14. The table base subassembly 210 is fabricated having a front corner framing 220. The base substrate 212 can be either a single piece having a mouse tray receiving cavity 240 formed within a side portion of the base substrate 212, or of two pieces provided in a generally parallel relation along a front edge and a rear edge, being assembled to a central member spanning there between, providing a base top surface 214. The two pieces would be spacially positioned forming the mouse tray receiving cavity 240 there between. A pair of tabletop framing subassemblies are located proximate each of a left and a right edge of the base substrate 212. The tabletop framing subassemblies comprise a support brace substrate 282 having raised corner frame elements at each of the outer front and rear corners. The front corner frame element comprises a front corner framing 220 and a forward sidewall corner framing 224 as illustrated. The rear corner frame element comprises a rear corner framing 222 and a rearward sidewall corner framing 226 as illustrated. A series of support brace receiving features 280 are provided along a top surface of the support brace substrate 282. The tabletop framing subassemblies simplify the manufacturing process, such as wherein the base substrate 212 is fabricated of two parallel members that are attached directly to an underside of the support brace substrate 282. A mouse tray 230 is similar to the mouse tray 130 described above, wherein the mouse tray 230 is slideably inserted into the mouse tray receiving cavity 240, engaging a engaging flange 234 with a receiving rail system (not shown, but well understood). The rails can be formed within the mouse tray receiving cavity 240 or integrated as a separate element being assembled within the mouse tray receiving cavity 240.

A tilting tabletop assembly 250 is positioned onto the base top surface 214, being contained via the front corner framing 220 and forward sidewall corner framing 224 for right handed use, or contained via the rear corner framing 222 and the rearward sidewall corner framing 226 for left handed use. The tilting tabletop assembly 250 integrates an angle support assembly 270 onto a lower surface of a tilting tabletop 252. The angle support assembly 270 maintains the tilting tabletop 252 at a desired angle. The exemplary angle support assembly 270 is formed of a thick wire, round rod, or tubular structure, and pivotally assembled to the lower surface of the tilting tabletop 252 via a pair of support brace brackets 274. An angle support brace 272 extends generally perpendicular from each end of a support pivot section 275. A support foot 276 extends from and generally perpendicular to a distal end of the angle support brace 272. The support pivot section 275 pivots within the support brace bracket 274, aligning the support foot 276 for engagement with a support brace receiving feature 280. The support brace receiving feature 280 can be slots, hooks, or the like. The tilting tabletop 252 can optionally include a plurality of cooling apertures 262, providing airflow for assisting in cooling a laptop or other heat-generating device placed on the tilting tabletop 252. The tilting tabletop 252 can include a non-slip surface, similar to the anti-slip surface 160 described above. An optional table cover subassembly 264 can be included, having a table cover material 266 for covering the series of cooling apertures 262, providing a solid surface for writing on, eating upon, the comfort of reading a book, and the like. The table cover material 266 can be an acrylic, rubber, wood, plastic, and the like, and can be detached from the tilting tabletop 252 or attached via any reasonable means, including a hinge, a tie, and the like.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence. For example, it will be apparent to those skilled in the art that the various components of the table, particularly the table top and legs, can be manufactured using metal, plastic or any other suitable materials to achieve the desired functionality and characteristics.

What is claimed is:

1. A tilting table assembly, comprising:

a tabletop base assembly having a base bottom defined by a pair of base longitudinal edges and a pair of base lateral edges;

a pair of pivot tab receiving slots substantially located at each base longitudinal edge;

a tilting tabletop having a generally planar upper surface defined by a pair of top longitudinal edges and a pair of top lateral edges;

a pair of pivot tabs extending from one of the top longitudinal edges and positioned to removably engage with the pair of pivot tab receiving slots of one of the pair of longitudinal edges creating a hinge for the tilting tabletop in a first orientation and positioned to removably engage with the pair of pivot tab receiving slots on the other longitudinal edge creating a hinge for the tilting tabletop in a second orientation;

an angle support assembly extending downward from a tabletop lower surface proximate a midline of the tabletop lower surface and engaging with an angle support feature on the tabletop base assembly to enable positioning of the tabletop at a desired angle in the first orientation and the second orientation;

a mouse tray receiving cavity provided within one of the lateral edges of the tabletop base assembly; and a mouse tray being slideably inserted into the mouse tray receiving cavity.

2. The tilting table assembly as recited in claim 1, wherein the angle support feature is a series of recesses provided in a base top surface.

3. The tilting table assembly as recited in claim 1, the tabletop base assembly further comprising a peripheral wall being continuous about a perimeter, extending upwards from each of the pair of base longitudinal edges and the pair of base lateral edges.

4. The tilting table assembly as recited in claim 3, wherein the pivot tab receiving slots are provided through the peripheral wall.

5. The tilting table assembly as recited in claim 1, wherein an interface between the mouse tray and the mouse tray receiving cavity includes a tray latch and ejection system.

6. The tilting table assembly as recited in claim 5, wherein the tray latch and ejection system includes a cantilevered latch being integrated into the mouse tray.

7. The tilting table assembly as recited in claim 5, wherein the tray latch and ejection system includes an ejection spring.

8. The tilting table assembly as recited in claim 1, the tilting tabletop further comprising a series of cooling apertures.

9. A tilting table assembly, comprising:

a tabletop base assembly having a base bottom defined by a pair of base longitudinal edges and a pair of base lateral edges;

a pair of pivot tab receiving slots substantially located at each base longitudinal edge;

a tilting tabletop having a generally planar upper surface defined by a pair of top longitudinal edges and a pair of top lateral edges;

a pair of pivot tabs extending from one of the top longitudinal edges and positioned to removably engage with the pair of pivot tab receiving slots of one of the pair of longitudinal edges creating a hinge for the tilting tabletop in a first orientation and positioned to removably engage with the pair of pivot tab receiving slots on the other longitudinal edge creating a hinge for the tilting tabletop in a second orientation;

an angle support assembly extending downward from a tabletop lower surface proximate a midline of the tabletop lower surface and engaging with an angle support feature on the tabletop base assembly to enable positioning of the tabletop at a desired angle in the first orientation and the second orientation;

a mouse tray receiving cavity provided within one of the lateral edges of the tabletop base assembly;

a mouse tray being slideably inserted into the mouse tray receiving cavity; and a pair of adjustable legs pivotally joined to and extending downward from the tabletop base assembly, each pair of legs comprising a front leg segment, a rear leg segment and a leg connector for connecting the front leg segment and the rear leg segment proximate their distal ends.

10. The tilting table assembly as recited in claim 9, wherein the angle support feature is a series of recesses provided in a base top surface.

11. The tilting table assembly as recited in claim 9, the tabletop base assembly further comprising a peripheral wall being continuous about a perimeter, extending upwards from each of the pair of base longitudinal edges and the pair of base lateral edges.

12. The tilting table assembly as recited in claim 11, wherein the pivot tab receiving slots are provided through the peripheral wall.

13. The tilting table assembly as recited in claim 9, wherein an interface between the mouse tray and the mouse tray receiving cavity includes a tray latch and ejection system.

14. The tilting table assembly as recited in claim 13, wherein the tray latch and ejection system includes a cantilevered latch being integrated into the mouse tray.

15. The tilting table assembly as recited in claim 13, wherein the tray latch and ejection system includes an ejection spring.

16. The tilting table assembly as recited in claim 9, the tilting tabletop further comprising a series of cooling apertures.

17. A tilting table assembly, comprising:

a tabletop base assembly having a base bottom defined by a pair of base longitudinal edges and a pair of base lateral edges;

a pair of pivot tab receiving slots substantially located at each base longitudinal edge;

a tilting tabletop having a generally planar upper surface defined by a pair of top longitudinal edges and a pair of top lateral edges;

an anti-slip surface disposed upon the generally planar upper surface of the tilting tabletop;

a pair of pivot tabs extending from one of the top longitudinal edges and positioned to removably engage with the pair of pivot tab receiving slots of one of the pair of longitudinal edges creating a hinge for the tilting tabletop in a first orientation and positioned to removably engage with the pair of pivot tab receiving slots on the other longitudinal edge creating a hinge for the tilting tabletop in a second orientation;

an angle support assembly extending downward from a tabletop lower surface proximate a midline of the tabletop lower surface and engaging with an angle support feature on the tabletop base assembly to enable positioning of the tabletop at a desired angle in the first orientation and the second orientation;

a mouse tray receiving cavity provided within one of the lateral edges of the tabletop base assembly; and a mouse tray being slideably inserted into the mouse tray receiving cavity.

18. The tilting table assembly as recited in claim 17, wherein the angle support feature is a series of recesses provided in a base top surface.

19. The tilting table assembly as recited in claim 17, wherein an interface between the mouse tray and the mouse tray receiving cavity includes a tray latch and ejection system.

20. The tilting table assembly as recited in claim 17, the tilting tabletop further comprising a series of cooling apertures.

* * * * *